US011768020B2

(12) United States Patent
Knight et al.

(10) Patent No.: US 11,768,020 B2
(45) **Date of Patent: *Sep. 26, 2023**

(54) SYSTEMS AND METHODS FOR REHEAT CONTROL OF AN HVAC SYSTEM

(71) Applicant: Johnson Controls Tyco IP Holdings LLP, Milwaukee, WI (US)

(72) Inventors: John T. Knight, Moore, OK (US); Stephen B. Pickle, Norman, OK (US); Norman J. Blanton, Norman, OK (US); Kerry L Shumway, Norman, OK (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/892,956

(22) Filed: Aug. 22, 2022

(65) Prior Publication Data

US 2023/0087675 A1 Mar. 23, 2023

Related U.S. Application Data

(63) Continuation of application No. 16/513,499, filed on Jul. 16, 2019, now Pat. No. 11,421,923.

(Continued)

(51) Int. Cl.
*F25B 41/20* (2021.01)
*F24F 3/052* (2006.01)

(Continued)

(52) U.S. Cl.
CPC ..... *F25B 41/20* (2021.01); *F24F 3/0525* (2013.01); *F24F 3/153* (2013.01); *F24F 11/84* (2018.01);

(Continued)

(58) Field of Classification Search
CPC ..... F25B 41/20; F25B 41/24; F25B 41/28; F25B 2600/25; F25B 2700/00;

(Continued)

(56) References Cited

U.S. PATENT DOCUMENTS 5,509,272 A 4/1996 Hyde
5,752,389 A 5/1998 Harper (Continued)

FOREIGN PATENT DOCUMENTS

CA 2957726 A1 3/2016
CA 3043996 A1 2/2018

(Continued)

OTHER PUBLICATIONS

CoolingLogic, "CoolingLogic: Up early, saving billions." URL: http://coolinglogic.com/documents/MarketingFlyer_FINAL_HiRes8.5x11.pdf, retrieved from internet Oct. 27, 2022 (1 page).

(Continued)

*Primary Examiner* — Jenna M Hopkins
(74) *Attorney, Agent, or Firm* — Fletcher Yoder, P.C.

(57) ABSTRACT

A heating, ventilation, and/or air conditioning (HVAC) unit includes a first sensor disposed adjacent to an inlet of an evaporator configured to receive an airflow. The HVAC unit includes a second sensor disposed adjacent to an outlet of a reheat coil positioned downstream of the evaporator and configured to expel the airflow. The HVAC unit also includes a controller configured to regulate operation of a modulating reheat valve to adjust flow of a working fluid in thermal communication with the airflow to control a difference between a measurement of the first sensor and a measurement of the second sensor.

19 Claims, 6 Drawing Sheets

Related U.S. Application Data

(60) Provisional application No. 62/851,516, filed on May 22, 2019.

(51) Int. Cl.
*F24F 3/153* (2006.01)
*F24F 11/84* (2018.01)

(52) U.S. Cl.
CPC ..... *F25B 2600/25* (2013.01); *F25B 2700/00* (2013.01)

(58) Field of Classification Search
CPC ..... F24F 3/0525; F24F 3/153; F24F 11/84; F24F 11/80; F24F 11/83; F24F 11/30; F24F 11/70; F24F 2110/10
See application file for complete search history.

(56) References Cited

U.S. PATENT DOCUMENTS

| | | | | |
|---|---|---|---|---|
| 6,055,818 | A * | 5/2000 | Valle | F25B 49/027 62/196.4 |
| 6,260,366 | B1 | 7/2001 | Pan | |
| 6,427,461 | B1 | 8/2002 | Whinery et al. | |
| 6,666,040 | B1 | 12/2003 | Groenewold et al. | |
| 6,672,087 | B1 | 1/2004 | Taras et al. | |
| 6,826,921 | B1 | 12/2004 | Uselton | |
| 6,941,770 | B1 | 9/2005 | Taras et al. | |
| 7,028,492 | B2 * | 4/2006 | Taras | B60H 1/3207 62/196.4 |
| 7,219,505 | B2 | 5/2007 | Weber et al. | |
| 7,275,384 | B2 | 10/2007 | Taras et al. | |
| 7,434,415 | B2 | 10/2008 | Knight et al. | |
| 7,726,140 | B2 | 6/2010 | Rayburn et al. | |
| 7,913,501 | B2 | 3/2011 | Ellis et al. | |
| 8,229,597 | B2 | 7/2012 | Burton | |
| 9,447,985 | B2 | 9/2016 | Johnson | |
| 9,964,346 | B2 | 5/2018 | Hua | |
| 10,066,860 | B2 | 9/2018 | Downie et al. | |
| 10,871,756 | B2 | 12/2020 | Johnson et al. | |
| 10,908,578 | B2 | 2/2021 | Johnson et al. | |
| 10,921,768 | B2 | 2/2021 | Johnson et al. | |
| 11,156,978 | B2 | 10/2021 | Johnson et al. | |
| 2004/0194371 | A1 | 10/2004 | Kinnis | |
| 2008/0173035 | A1 | 7/2008 | Thayer et al. | |
| 2011/0154837 | A1 | 6/2011 | Taras | |
| 2017/0234564 | A1 * | 8/2017 | Goel | F24F 3/14 62/93 |
| 2018/0313555 | A1 | 11/2018 | Henderson | |
| 2019/0193517 | A1 | 6/2019 | Kobayashi | |
| 2022/0228758 | A1 * | 7/2022 | Garg | F24F 11/77 |

FOREIGN PATENT DOCUMENTS

| | | | |
|---|---|---|---|
| CN | 108679747 | A | 10/2018 |
| EP | 0001378 | A2 | 4/1979 |
| EP | 3 186 687 | A4 | 7/2017 |
| EP | 3 497 377 | A1 | 6/2019 |

OTHER PUBLICATIONS

Incomplete File of Communication with Various Companies, etc. in 2016-2021, URL: http://coolinglogic.com/documents/22072101_Letters_and_Signature_Receipts.pdf, published, as one document, on: Jul. 21, 2022 (211 pages).

Johnson Heating and Cooling L.L.C., "Divine Grace Building Automation (Images)," URL: http://cooljohnson.com/Building-Automation-Systems-Michigan/Oakland-County-Michigan/Building-Automation-Images.html, retrieved from internet Oct. 27, 2022 (8 pages).

Johnson Heating and Cooling L.L.C., "Divine Grace Building Automation," URL: http://cooljohnson.com/Building-Automation-Systems-Michigan/Oakland-County-Michigan/Building-Automation-Divine-Grace.html, retrieved from internet Oct. 27, 2022 (3 pages).

Johnson Heating and Cooling L.L.C., "Excel Rehabilitation Building Automation," URL: http://cooljohnson.com/Building-Automation-Systems-Michigan/Waterford-Michigan/Building-Automation-System--Excel.html, retrieved from internet Oct. 27, 2022 (2 pages).

Johnson Heating and Cooling L.L.C., "Intertek Testing Services Building Automation," URL: http://cooljohnson.com/Building-Automation-Systems-Michigan/Plymouth-Michigan/Building-Automation-System-Plymouth-Michigan.html, retrieved from internet Oct. 27, 2022 (8 pages).

Johnson Heating and Cooling L.L.C., "JLA Medical Building Building Automation," URL: http://cooljohnson.com/Building-Automation-Systems-Michigan/Waterford-Michigan/Building-Automation-System--JLA.html, retrieved from internet Oct. 27, 2022 (3 pages).

Johnson Heating and Cooling L.L.C., "Mosaic Christian Building Automation (Images)," URL: http://cooljohnson.com/Building-Automation-Systems-Michigan/Detroit/Building-Automation-Images.html, retrieved from internet Oct. 27, 2022 (12 pages).

Johnson Heating and Cooling L.L.C., "Mosaic Christian Building Automation," URL: http://cooljohnson.com/Building-Automation-Systems-Michigan/Detroit/Mosaic-Christian.html, retrieved from internet Oct. 27, 2022 (5 pages).

Johnson Heating and Cooling L.L.C., "Shepherd's Gate Lutheran Church Building Automation," URL: http://cooljohnson.com/Building-Automation-Systems-Michigan/Shelby-Township-Michigan/Building-Automation-Systems-SG.html, retrieved from internet Oct. 27, 2022 (3 pages).

Johnson Heating and Cooling L.L.C., "St. Clair County Residence Building Automation," URL: http://cooljohnson.com/Building-Automation-Systems-Michigan/St-Clair-Michigan/Building-Automation-System-St-Clair-Michigan.html, retrieved from internet Oct. 27, 2022 (4 pages).

Johnson Heating and Cooling L.L.C., "St. Joseph Mercy Oakland U. C. Building Automation," URL: http://cooljohnson.com/Building-Automation-Systems-Michigan/Waterford-Michigan/Building-Automation-Systems-SJMO.html, retrieved from internet Oct. 27, 2022 (2 pages).

Johnson Heating and Cooling L.L.C., "Waterford Internal Medicine Building Automation," URL: http://cooljohnson.com/Building-Automation-Systems-Michigan/Waterford-Michigan/Building-Automation-Systems-WIM.html, retrieved from internet Oct. 27, 2022 (3 pages).

Johnson Heating and Cooling, LLC, "Building Automation Clawson Michigan 2.0," URL: http://cooljohnson.com/Building-Automation-Systems-Michigan/Clawson-Michigan/Building-Automation-Clawson-Manor-2.html, retrieved from the internet Oct. 27, 2022 (6 pages).

Johnson Heating and Cooling, LLC, "Building Automation Images Clawson Michigan 2.0," URL: http://cooljohnson.com/Building-Automation-Systems-Michigan/Clawson-Michigan/Building-Automation-Clawson-Manor-2-Images.html, retrieved from the internet Oct. 27, 2022 (14 pages).

Johnson Heating and Cooling, LLC, "Building Automation System Clawson Michigan Clawson Manor," URL: http://cooljohnson.com/Building-Automation-Systems-Michigan/Clawson-Michigan/Building-Automation-System-Clawson-Manor.html; retrieved from the internet Oct. 27, 2022 (3 pages).

Johnson Heating and Cooling, LLC, "Building Automation System in Michigan Images," URL: http://cooljohnson.com/Building-Automation-Systems-Michigan/Macomb-County-Michigan/Building-Automation-Images.html; retrieved from the internet Oct. 27, 2022 (13 pages).

Johnson Heating and Cooling, LLC, "Building Automation System in Michigan," URL: http://cooljohnson.com/Building-Automation-Systems-Michigan/Macomb-County-Michigan/Building-Automation-Confidential-Customer.html; retrieved from the internet, Oct. 27, 2022 (4 pages).

Johnson Solid State LLC, "Building Automation Equipment," URL: http://cooljohnson.com/Video/Building_Automation/Confidential_Customer_BLD_2/Building_Automation_Equipment.mp4, retrieved from internet Oct. 27, 2022 (35 pages).

(56) References Cited

OTHER PUBLICATIONS

Johnson Solid State LLC, "Building Automation GUI," URL: http://cooljohnson.com/Video/Building_Automation/Confidential_Customer_BLD_2/Building_Automation_GUI.mp4, retrieved from internet Oct. 27, 2022 (24 pages).
Johnson Solid State LLC, "Cooling Logic Overview," URL: http://coolinglogic.com/documents/CoolingLogic_Overview_High_Quality.mp4, retrieved from internet Oct. 27, 2022 (16 pages).
Johnson Solid State LLC, "So what is CoolingLogic™?" URL: http://coolinglogic.com/Coolinglogic-How-it-Works.html, retrieved from the internet Oct. 27, 2022 (3 pages).
Johnson, David, "A Method to Increase HVAC System Efficiency And Decrease Energy Consumption," White Paper: Johnson Solid State, LLC, URL: http://coolinglogic.com/documents/16102106_White_Paper_High_Resolution_Protected.pdf, Sep. 24, 2016 (51 pages).
Johnson, David, "CoolingLogic™: Mosaic Christian Church A Case Study," Report: Johnson Solid State, LLC, URL: http://coolinglogic.com/documents/19020301_Mosaic_Christian_Coolinglogic_Case_Study.pdf, Feb. 2, 2019 (140 pages).
Johnson, David, "Excel Rehabilitation Building Automation: Building Automation System User Manual ," URL: http://cooljohnson.com/Building-Automation-Systems-Michigan/Waterford-Michigan/Building-Automation-System-Excel-Manual.html, 2012 (10 pages).
Johnson, David, "Temperature Control System and Methods for Operating Same," Pre-Publication printout of U.S. Appl. No. 15/231,943, filed Aug. 9, 2016, URL: http://coolinglogic.com/documents/16080901_CIP_As_Filed.pdf (99 pages).
Johnson, David., "CoolingLogic™: Changing the Way You Cool," Report: Johnson Solid State, LLC, URL: http://coolinglogic.com/documents/18111303_Changing_the_way_you_Cool.pdf, Nov. 7, 2018 (12 pages).

* cited by examiner

SYSTEMS AND METHODS FOR REHEAT CONTROL OF AN HVAC SYSTEM

CROSS-REFERENCE TO RELATED APPLICATIONS

This is a continuation application of U.S. patent application Ser. No. 16/513,499, entitled "SYSTEMS AND METHODS FOR REHEAT CONTROL OF AN HVAC SYSTEM," filed Jul. 16, 2019, which claims priority from and the benefit of U.S. Provisional Application No. 62/851,516, entitled "SYSTEMS AND METHODS FOR REHEAT CONTROL OF AN HVAC SYSTEM," filed May 22, 2019, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system may be used to thermally regulate an environment, such as a space within a building, home, or other structure. The HVAC system generally includes a vapor compression system that includes heat exchangers, such as a condenser and an evaporator, which transfer thermal energy between the HVAC system and the environment. In some cases, the HVAC system also includes a reheat coil, which, together with the evaporator, is positioned along an air flow path of the HVAC system. The evaporator and the reheat coil may operate concurrently to facilitate dehumidification of an air flow traveling along the air flow path and entering a building serviced by the HVAC system. Unfortunately, conventional HVAC systems may be unable to efficiently control a rate of heat transfer between the evaporator, the reheat coil, and the air flow, thereby rendering the HVAC systems inadequate to efficiently control a temperature of dehumidified air being discharged from the HVAC systems.

SUMMARY

The present disclosure relates to a heating, ventilation, and/or air conditioning (HVAC) unit that includes a first sensor disposed adjacent to an inlet of an evaporator configured to receive an airflow. The HVAC unit includes a second sensor disposed adjacent to an outlet of a reheat coil positioned downstream of the evaporator and configured to expel the airflow. The HVAC unit also includes a controller configured to regulate operation of a modulating reheat valve to adjust flow of a working fluid in thermal communication with the airflow to control a difference between a measurement of the first sensor and a measurement of the second sensor.

The present disclosure also relates to a heating, ventilation, and/or air conditioning (HVAC) unit that includes a first sensor configured to detect a first temperature of an airflow entering the HVAC unit as return air and a second sensor configured to detect a second temperature of the airflow being provided as supply air conditioned by the HVAC unit. The HVAC unit also includes a controller configured to adjust a modulating reheat valve of the HVAC unit to adjust flow of a working fluid in thermal communication with the airflow to control a difference between the first temperature and the second temperature.

The present disclosure also relates to a heating, ventilation, and/or air conditioning (HVAC) unit that includes an enclosure defining an air flow path. The HVAC unit includes an evaporator and a reheat coil disposed within the air flow path such that the evaporator is upstream of the reheat coil. The HVAC unit also includes a first sensor positioned adjacent to an upstream side of the evaporator along the air flow path and a second sensor positioned adjacent to a downstream side of the reheat coil along the air flow path. The HVAC unit further includes a controller configured to adjust a modulating reheat valve of the HVAC unit to control a difference between a measurement of the first sensor and a measurement of the second sensor.

DETAILED DESCRIPTION

Figure 1:
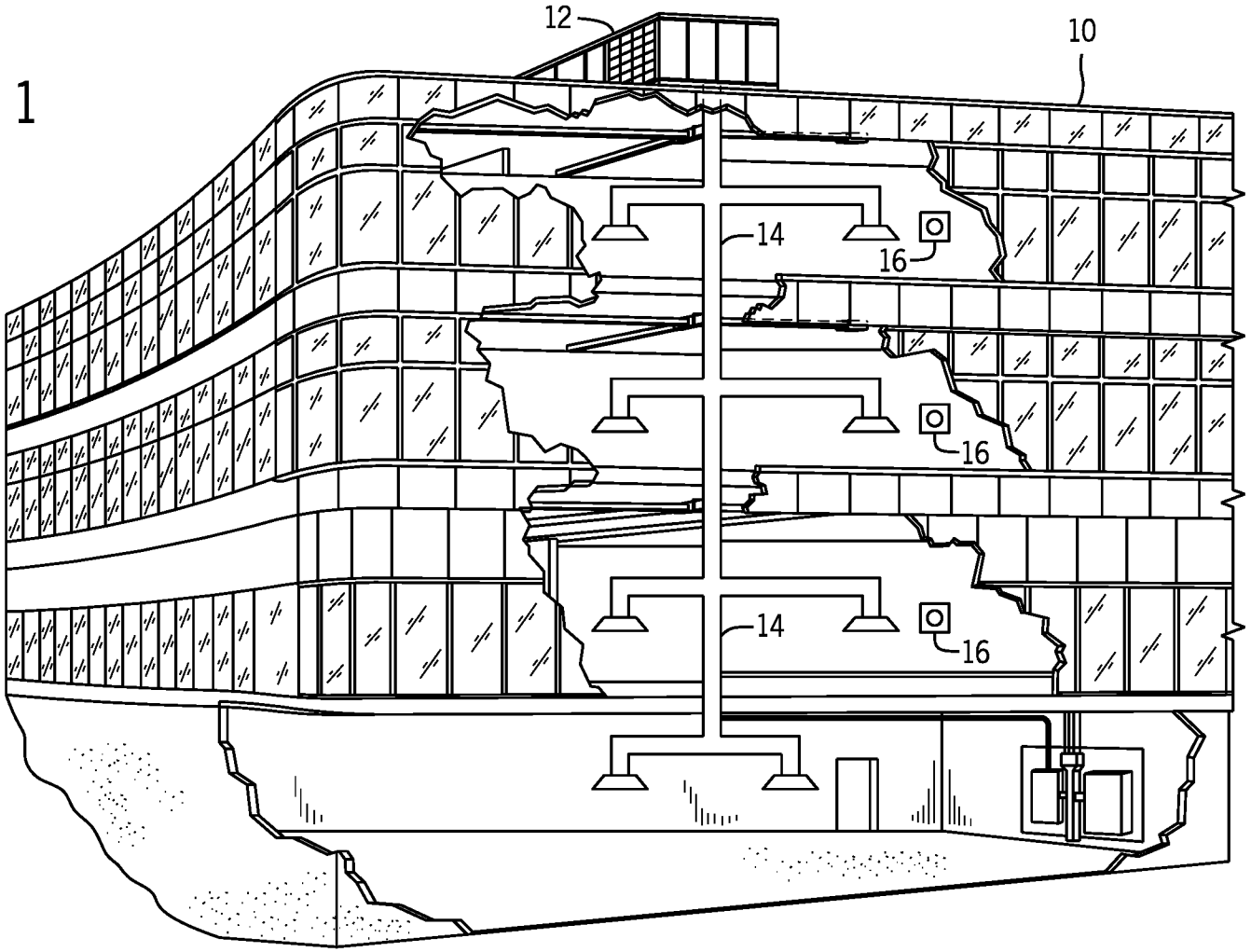
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes a condenser and an evaporator that are fluidly coupled to one another via a conduit. A compressor may be used to circulate the refrigerant through the conduit and, thus, enable the transfer of thermal energy between the condenser and the evaporator via the refrigerant.

For example, the evaporator may be positioned within an air flow path of the HVAC system that enables the HVAC system to draw air from and direct air into a building. Specifically, a fan or blower may be used to draw a flow of return air from within the building and into the air flow path, to direct the return air across a heat exchange area of the evaporator, and to discharge the return air back into the building as conditioned supply air. Cooled refrigerant circulating through the evaporator may absorb thermal energy from the return air flowing thereacross, thereby enabling the evaporator to discharge the return air as the conditioned supply air, which includes a temperature that is less than a temperature of the return air. In this manner, the HVAC system may be used to regulate an air temperature within an interior of the building.

In certain cases, the HVAC system may include a reheat coil that may be positioned downstream of the evaporator, with respect to a direction of air flow across the evaporator. The reheat coil may be fluidly coupled to the vapor compression system, and the reheat coil may be configured to heat, rather than cool, a flow of air circulating through the HVAC system. Accordingly, when operating concurrently with the evaporator, the reheat coil may facilitate dehumidification of the return air entering the HVAC system. For example, as the return air flows across the evaporator, the evaporator may condense moisture suspended or contained within the return air, such that the evaporator discharges the return air as cooled, dehumidified air. The compressor may be configured to receive a flow of heated refrigerant discharging from the evaporator, which has previously absorbed thermal energy from the return air. The compressor may subsequently direct the heated refrigerant through one or more valves, which may be positionable to direct at least a portion of the heated refrigerant to the reheat coil. The cooled, dehumidified air may be directed across a heat exchange area of the reheat coil to enable the dehumidified air to re-absorb thermal energy from the heated refrigerant circulating through the reheat coil. Accordingly, the reheat coil may increase a temperature of the dehumidified air. In this way, the return air may be dehumidified to create the conditioned supply air that is discharged into the building or other conditioned space. Unfortunately, conventional HVAC systems may be unable to efficiently control an amount of the heated refrigerant supplied to the reheat coil, such that the reheat coil may overheat or not sufficiently heat, relative to a current temperature within an interior of a building, the dehumidified air discharged from the evaporator. Accordingly, conventional HVAC systems may be ill-equipped to operate in a dehumidification mode to dehumidify an air flow supplied to the building without heating or cooling the interior of the building with the dehumidified air flow.

It is now recognized that more efficiently regulating refrigerant flow to the reheat coil enables fine-tuned adjustment of a temperature of dehumidified air that is discharged from the HVAC system and directed into a building or other structure. In particular, it is now recognized that enabling adjustability in a heat exchange rate between the reheat coil and air flowing thereacross enables HVAC system to efficiently discharge dehumidified air at a temperature that is substantially equal to a temperature within a space receiving the dehumidified air.

Accordingly, embodiments of the present disclosure are directed to a reheat control system that is configured to regulate an amount of heated refrigerant supplied to the reheat coil based on certain operational parameters of the HVAC system to enable the HVAC system to provide dehumidified air to a building at a temperature that is substantially equal to, such as within ten percent of, a current temperature within an interior of the building. For example, in some embodiments, the reheat control system may include a first temperature sensor that is positioned upstream of the evaporator and a second temperature sensor that is positioned downstream of the reheat coil. The first temperature sensor may be configured to measure a temperature of return air entering an enclosure or a housing of the HVAC system, and the second temperature sensor may be configured to measure a temperature of supply air being discharged from the enclosure and directed into the building. In certain embodiments, the reheat control system may adjust a flow rate of heated refrigerant supplied to the reheat coil based on a temperature differential between the measured temperature of the supply air and the measured temperature of the return air. For example, in certain embodiments, the reheat control system may be configured to adjust a flow rate of the heated refrigerant supplied to the reheat coil such that a temperature of the supply air discharging from the reheat coil is substantially equal to a temperature of the return air entering the HVAC system enclosure. Accordingly, the reheat control system may enable the HVAC system to operate in a dehumidification mode, in which the HVAC system is configured to dehumidify an air flow entering the HVAC system without effectively heating or cooling a structure configured to receive the air flow. In other words, the HVAC system may receive a return air flow from a conditioned space, dehumidify the air flow to generate a conditioned supply air flow having a temperature substantially similar to a temperature within the conditioned space, and discharge the conditioned supply air flow to the conditioned space. These and other features will be described below with reference to the drawings.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
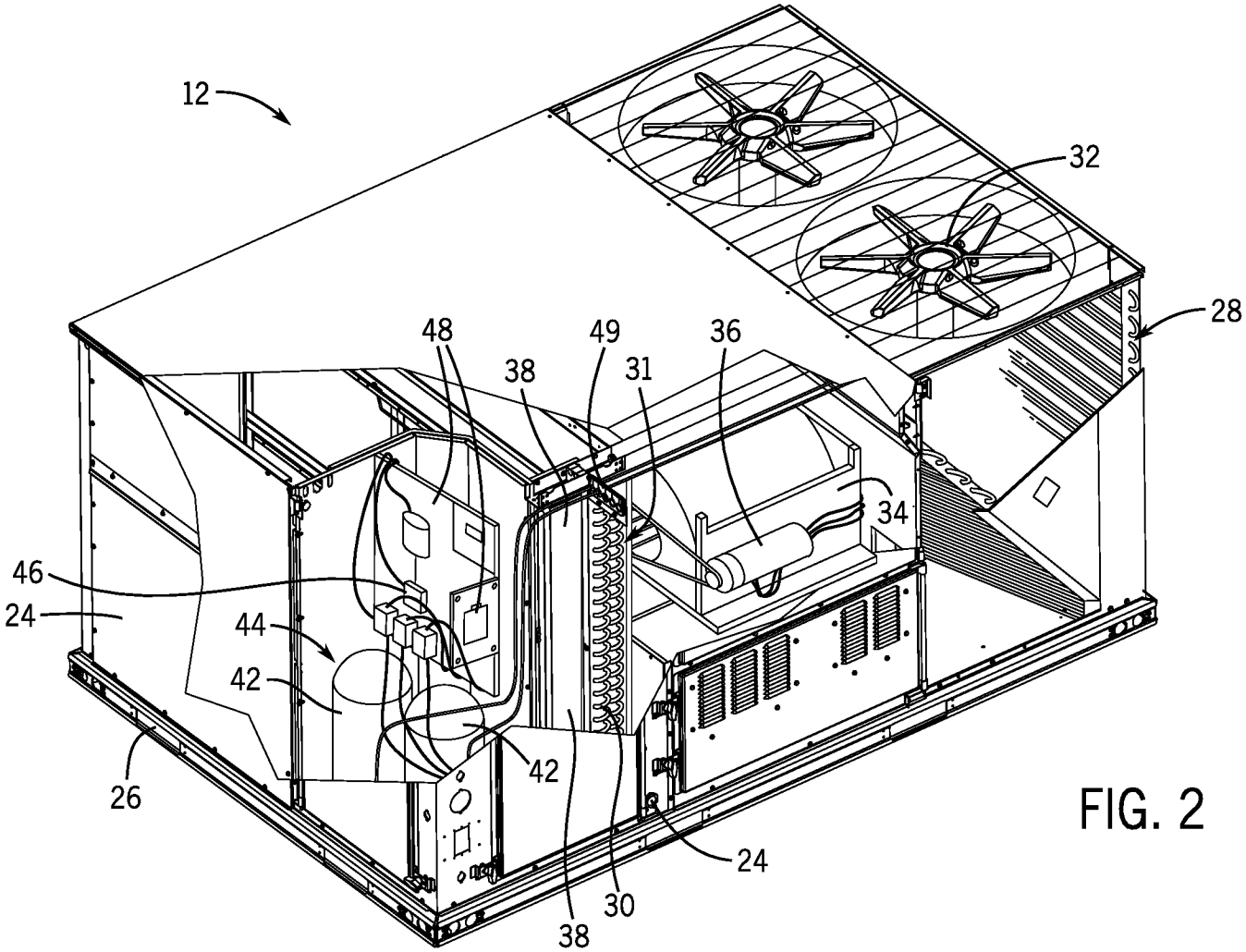
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
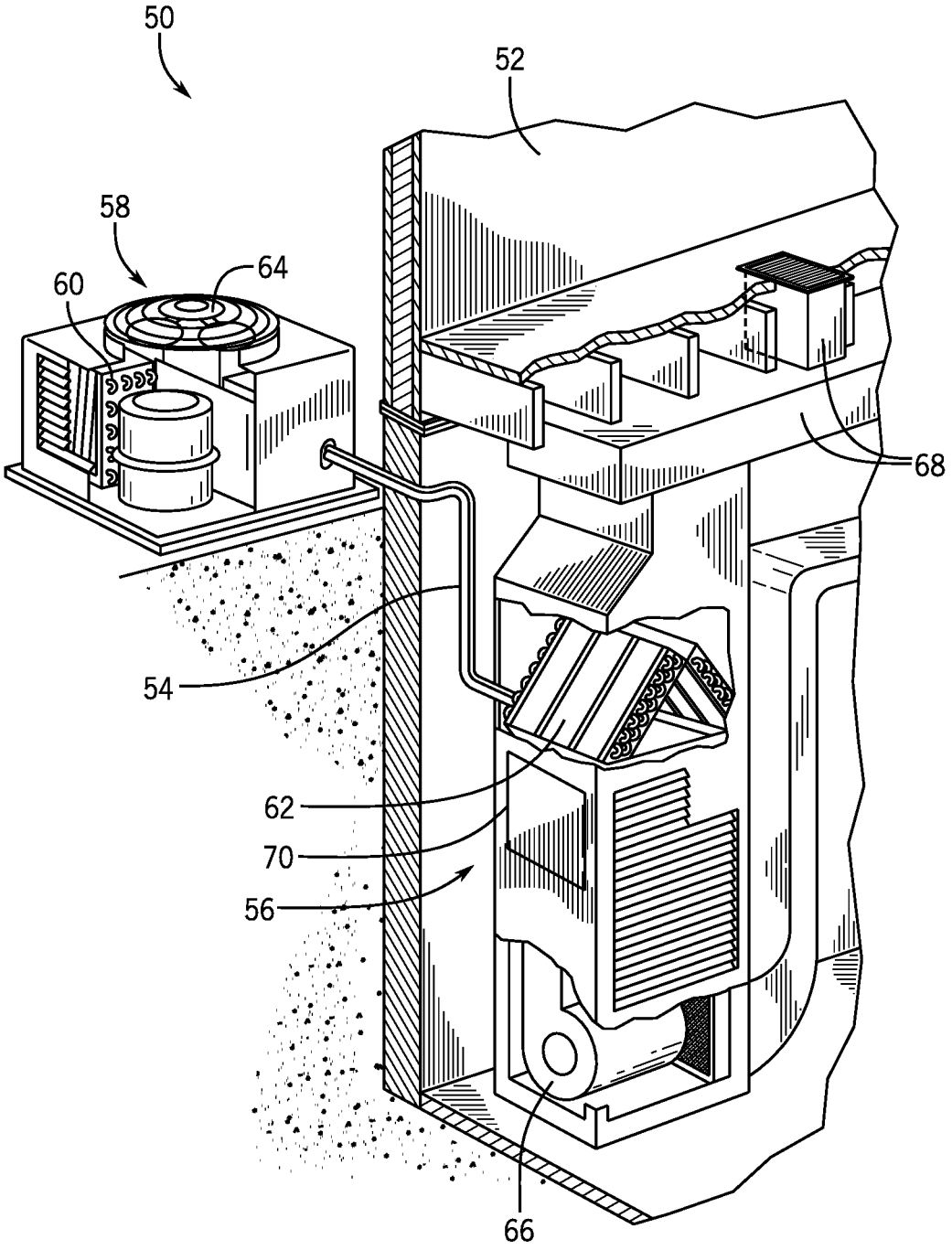
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
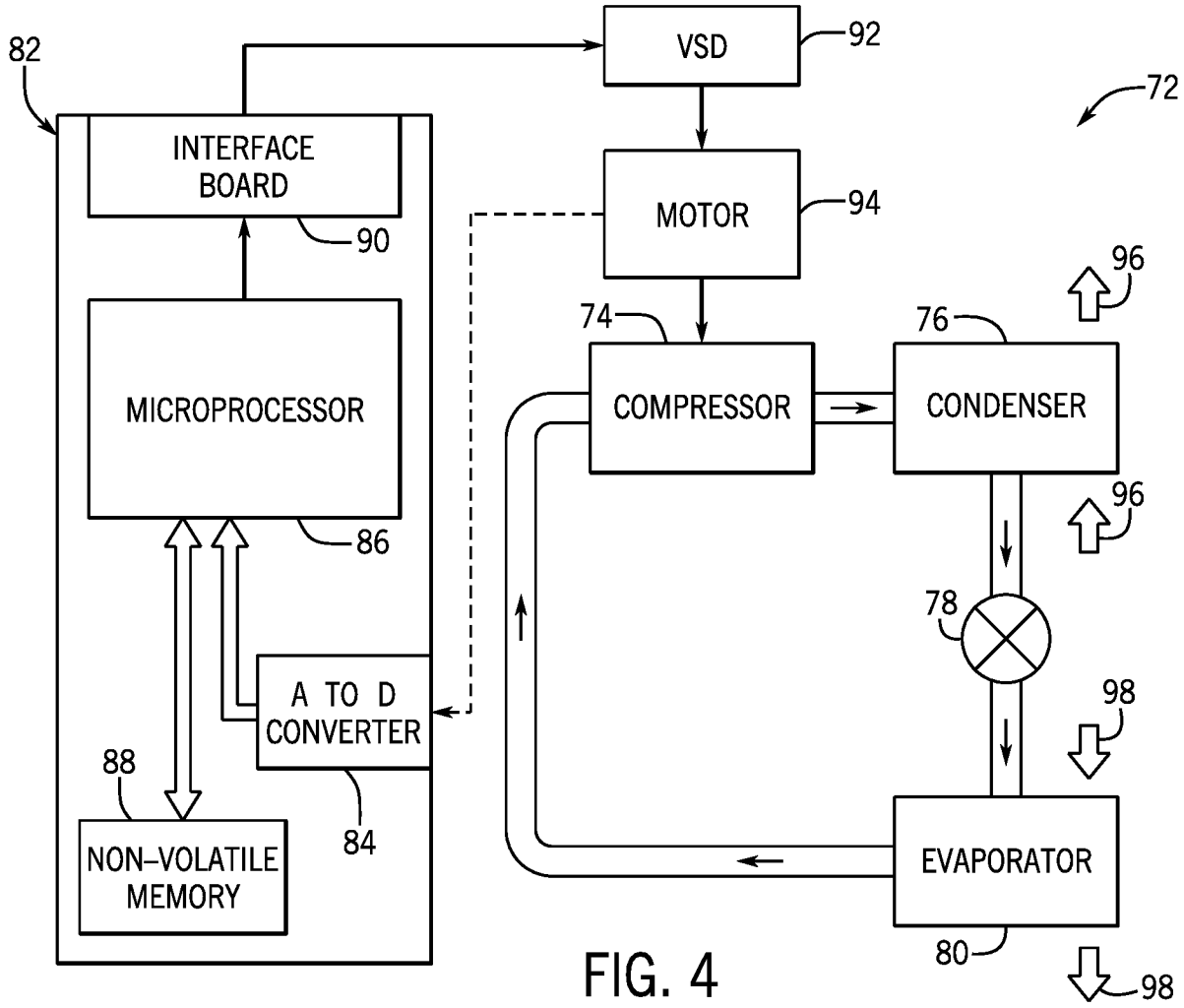
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
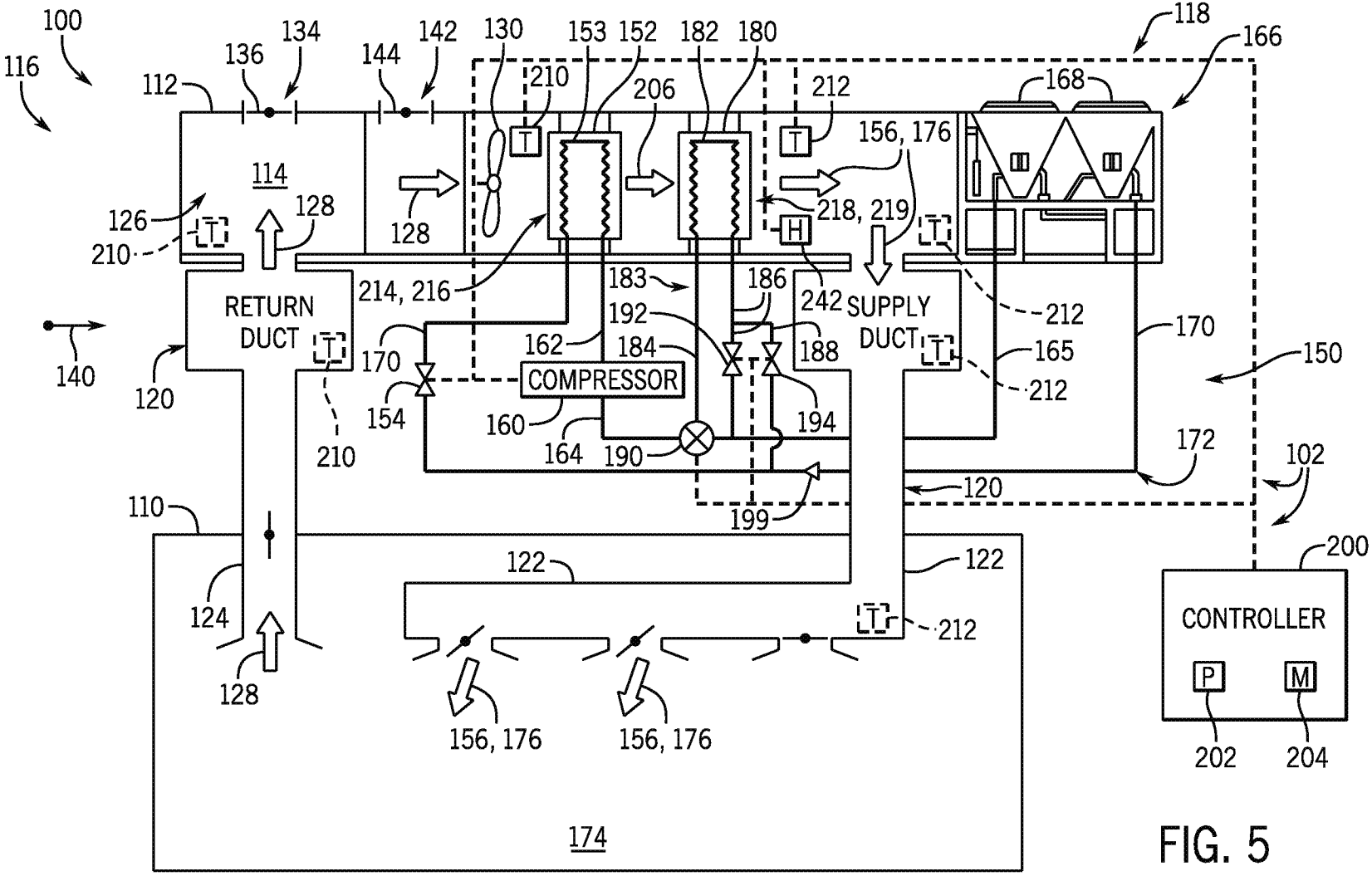
FIG. 5 is a schematic diagram of an embodiment of an HVAC system having a reheat coil, in accordance with an aspect of the present disclosure.

As briefly discussed above, HVAC systems may include an evaporator, also referred to herein an evaporator assembly, and a reheat coil that may cooperate to dehumidify an air flow to be provided to a room or zone of a building. Embodiments of the present disclosure are directed to a reheat control system that enables efficient supply of dehumidified air to a room or zone of a building without heating or cooling the room or zone. That is, the reheat control system enables the HVAC system to provide dehumidified air to the room or zone at a temperature that is substantially equal to a temperature of return air extracted from the room or zone by the HVAC system and/or substantially equal to an air temperature within the room or zone. To provide context for the following discussion, FIG. 5 is a schematic of an embodiment of an HVAC system 100 having a reheat control system 102. It should be appreciated that the HVAC system 100 may include embodiments or components of the HVAC unit 12 shown in FIGS. 1 and 2, embodiments or components of the split residential heating and cooling system 50 shown in FIG. 3, a rooftop unit (RTU), or any other suitable air handling unit or HVAC system.

The HVAC system 100 may be configured to circulate a flow of conditioned air through a thermal load 110, such as a space within a building, residential home, or other suitable structure. The HVAC system 100 includes an enclosure 112 that forms an air flow path 114 through the HVAC system 100. The air flow path 114 extends from an upstream end portion 116 of the HVAC system 100 to a downstream end portion 118 of the HVAC system 100. The enclosure 112 may be in fluid communication with the thermal load 110 via an air distribution system, such as a system of ductwork 120, which includes a supply duct 122 and an exhaust duct 124. The exhaust duct 124 may be coupled to an exhaust air plenum 126 of the enclosure 112 that is configured to receive a flow of return air 128 from the thermal load 110. Particularly, a fan or blower 130 of the HVAC system 100 may be operable to draw the return air 128 into the enclosure 112 via the exhaust duct 124. In some embodiments, the enclosure 112 includes an exhaust air outlet 134 that enables the HVAC system 100 to exhaust a portion of the return air 128 into an ambient environment, such as the atmosphere. The exhaust air outlet 134 generally includes an exhaust air damper 136 that is configured to regulate a flow rate of the exhaust air discharging through the exhaust air outlet 134. In the illustrated embodiment, the exhaust air damper 136 is in a closed position, such that substantially all return air 128 entering the exhaust air plenum 126 is directed along the air flow path 114 in a downstream direction 140 from the upstream end portion 116 to the downstream end portion 118 of the HVAC system 100.

In some embodiments, the enclosure 112 includes an outdoor air inlet 142 that may enable the HVAC system 100 to intake fresh outdoor air from the ambient environment. The outdoor air inlet 142 may include an outdoor air damper 144 that is configured to regulate a flow rate of the outdoor air entering the enclosure 112. In the illustrated embodiment, the outdoor air damper 144 is in a closed position, such that substantially no outdoor air may enter the enclosure 112 via the outdoor air inlet 142.

The HVAC system 100 may include a vapor compression system 150, such as the vapor compression system 72, which enables the HVAC system 100 to regulate one or more climate parameters within the thermal load 110. For example, the vapor compression system 150 may include an evaporator assembly 152 that is positioned within the air flow path 114 and is configured to receive a flow of cooled refrigerant from an expansion device 154 of the vapor compression system 150. The blower 130 may force the return air 128 across the evaporator assembly 152, such that cooled refrigerant circulating through one or more evaporator coils 153 of the evaporator assembly 152 may absorb thermal energy from the return air 128. Accordingly, the evaporator assembly 152 may discharge a flow of cooled supply air 156 that may flow along the air flow path 114 toward the supply duct 122 and into the thermal load 110.

The evaporator assembly 152 may discharge, via a conduit 162, a flow of heated refrigerant that has absorbed thermal energy from the return air 128. The heated refrigerant may flow through the conduit 162 and toward a compressor 160 of the vapor compression system 150. The compressor 160 may direct the heated refrigerant through conduits 164 and 165 and into a condenser assembly 166 that, in some embodiments, may form the downstream end portion 118 of the HVAC system 100. The condenser assembly 166 may include one or more condenser coils that are configured to receive the heated refrigerant from the compressor 160 and to facilitate heat exchange between the heated refrigerant and the ambient environment. For example, the condenser assembly 166 may include one or more condenser fans 168 that are operable to draw a flow of ambient air across the condenser coils of the condenser assembly 166. Accordingly, the ambient air may absorb thermal energy from the refrigerant circulating through the condenser coils, thereby cooling the refrigerant before the refrigerant is discharged from the condenser assembly 166 via a conduit 170. The compressor 160 may subsequently recirculate, via the conduit 170, the cooled refrigerant to the evaporator assembly 152 for reuse. As such, the evaporator assembly 152, the expansion device 154, the compressor 160, the condenser assembly 166, and the conduits 162, 164, 165, 170 may collectively form a refrigerant loop or circuit 172 of the vapor compression system 150. Operation of the vapor compression system 150 may therefore enable the HVAC system 100 to control one or more climate parameters within the thermal load 110. In particular, the HVAC system 100 may be operable to condition an interior 174 of the thermal load 110 by cooling a flow of the return air 128 circulating through the HVAC system 100.

As noted above, in some embodiments, it may be desirable to operate the HVAC system 100 in a dehumidification mode, in which the HVAC system 100 circulates return air 128 and supply air 156 without heating or cooling the interior 174 of the thermal load 110. More specifically, in the dehumidification mode, the HVAC system 100 is configured to dehumidify air within the interior 174 of the thermal load 110 without heating or cooling the interior 174. That is, it may be desirable to dehumidify the return air 128 entering the HVAC system 100 and to discharge the return air 128 as dehumidified neutral air 176 that has a temperature that is substantially equal to a temperature of the return air 128 and/or that is substantially equal to a temperature within the interior 174 of the thermal load 100. As used herein, a flow of "neutral air" or "near neutral air" may refer to a flow of supply air 156 having a temperature value that is substantially equal to, such as within ten percent of, or within two degrees of, a temperature value of the return air 128, and that includes a humidity level that is less than a humidity level of the return air 128. That is, "neutral air" or "near neutral air" may refer to a flow of the supply air 156 that, at a particular instance in time, has a temperature that is substantially equal to a temperature within the interior 174 of the thermal load 110 at that same instance in time. Accordingly, it should be understood that, when supplying the thermal load 110 with the supply air 156 having properties of the "neutral air" or the "near neutral air," the HVAC system 100 may circulate air throughout the thermal load 110 to dehumidify the thermal load 110 substantially without heating or cooling the interior 174 of the thermal load 110. To effectively and efficiently provide the thermal load 110 with the neutral air 176, the HVAC system 100 discussed herein includes the reheat control system 102 having a reheat coil 180, which, as discussed in detail below, enables the HVAC system 100 to operate in the dehumidification mode to dehumidify the return air 128 circulating through the HVAC system 100 without effectively heating or cooling the interior 174 of the thermal load 110.

As shown in the illustrated embodiment, the reheat coil 180 is disposed within the air flow path 114 and is positioned downstream, with respect to a direction of air flow through the enclosure 112, of the evaporator assembly 152. One or more coils 182 of the reheat coil 180 may be fluidly coupled to the refrigerant loop 172 via a conduit system 183 that includes a conduit 184, a conduit 186, a conduit 188, and a modulating valve 190. Accordingly, the coils 182 may place the refrigerant in thermal communication with air flowing along the air flow path 114. In some embodiments, the modulating valve 190, also referred to herein as a modulating reheat valve, may be a three-way modulating valve that is fluidly coupled to the conduits 164, 165, and 184. Accordingly, the modulating valve 190 is operable to regulate diversion of refrigerant, also referred to herein as a working fluid, from the compressor 160 to the reheat coil 180 and/or from the compressor 160 to the condenser assembly 166. In particular, the modulating valve 190 may control flow parameters, such as a flow rate and/or a flow pressure, of the refrigerant flowing from the compressor 160 into the coils 182 of the reheat coil 180 and/or of the refrigerant flowing from the compressor 160 into the condenser coils of the condenser assembly 166. For clarity, as used herein, a "modulating valve" may refer to any suitable valve or flow control device, such as a step-less valve, which is operable to incrementally adjust a flow rate and/or a flow pressure of a fluid flow across the modulating valve. For example, in some embodiments, the modulating valve 190 may be adjustable to 1, 5, 10, 20, 30, 50, or more than 50 discrete positions that enable precise adjustment of fluid flow parameters across the modulating valve 190. Indeed, it should be appreciated that the modulating valve 190 may be configured to simultaneously direct a first portion of the refrigerant discharging from the compressor 160 to the condenser assembly 166, such as via the conduit 165, and to direct a second portion of the refrigerant discharging from the compressor 160 to the reheat coil 180, such as via the conduit 184. Moreover, it should be understood that the modulating valve 190 may be configured to direct substantially all refrigerant discharging from the compressor 160 toward either the condenser assembly 166 or the reheat coil 180.

By selectively directing heated refrigerant discharging from the compressor 160 into the coils 182, the modulating valve 190 may enable the HVAC system 100 to operate in a dehumidification mode, in which the return air 128 entering the enclosure 112 at an initial temperature is cooled by the evaporator assembly 152, in order to condense moisture within the return air 128, and is subsequently reheated to the initial temperature by the reheat coil 180. In this manner, the HVAC system 100 may dehumidify an air flow circulating through the enclosure 112 without heating or cooling the thermal load 110.

For example, the evaporator coils 153 may, in some embodiments, absorb an amount of thermal energy from the return air 128 that is sufficient to cause moisture suspended within the return air 128 to condense on the evaporator coils 153. Accordingly, the return air 128 may discharge from the evaporator assembly 152 as cooled, dehumidified air 206 having a temperature value and a humidity level that are less than a temperature value and a humidity level of the return air 128. The blower 130 may force the dehumidified air 206 across the coils 182, which are positioned downstream of the evaporator coils 153, thereby enabling the dehumidified air 206 to absorb thermal energy from the heated refrigerant circulating through the coils 182. Accordingly, the reheat coil 180 may discharge the supply air 156 at a temperature value that is greater than a temperature value of the dehumidified air 206. As discussed in detail below, the reheat control system 102 includes a controller 200 that is configured to operate the modulating valve 190 to adjust flow parameters of the refrigerant entering the coils 182 based on one or more parameters of air entering and/or discharging from the enclosure 112. In particular, the controller 200 may adjust the modulating valve 190 to enable the HVAC system 100 to discharge the supply air 156 as the neutral air 176, such that the HVAC system 100 may provide the thermal load 110 with dehumidified air without heating or cooling the interior 174 of the thermal load 110.

As shown in the illustrated embodiment, the conduit system 183 may include a first valve 192 disposed along the conduit 186 and a second valve 194 disposed along the conduit 188. The conduit 186 is fluidly coupled to the conduit 165, and the conduit 188 is fluidly coupled to the conduit 170. Accordingly, the first and second valves 192, 194 may be operable to direct refrigerant from the reheat coil 180 to condenser assembly 166 or to enable the refrigerant to bypass the condenser assembly 166 and to flow from the reheat coil 180 directly toward the expansion device 154. For example, in some embodiments, the first valve 192 may be transitioned to an open position, and the second valve 194 may be transitioned to a closed positioned, such that heated refrigerant exiting the reheat coil 180 is directed toward the condenser assembly 166 via the conduit 165. In other embodiments, the first valve 192 may be transitioned to a closed position, and the second valve 194 may be transitioned to an open position, such that heated refrigerant exiting the reheat coil 180 may bypass the condenser assembly 166 and flow directly toward the expansion device 154 via the conduit 170. The refrigerant loop 172 may include one or more check valves 199 that are configured to block refrigerant flow from the conduit 188 to the condenser assembly 166 via the conduit 170. In some embodiments, the first and second valves 192, 194 may be replaced by a three-way modulating valve that is configured to selectively direct refrigerant exiting the reheat coil 180 to the condenser assembly 166, to the expansion device 154, or to both the condenser assembly 166 and the expansion device 154. In further embodiments, the conduit 186 and the first valve 192 or the conduit 188 and the second valve 194 may be omitted from the conduit system 183, such that refrigerant exiting the reheat coil 180 may be directed into either the conduit 165 or the conduit 170. In any case, the conduit system 183 may return refrigerant exiting the reheat coil 180 to the refrigerant loop 172. Furthermore, as discussed in detail below, the first and second valves 192, 194 may be used to adjust a heat exchange rate between air circulating through the enclosure 112 and the vapor compression system 150. For clarity, the first valve 192 and the second valve 194, collectively, may be referred to herein as a valve assembly of the HVAC system 100.

As noted above, the HVAC system 100 includes the controller 200, such as the control panel 82, which may be used to control components of the HVAC system 100 and components of the reheat control system 102 to enable operation of the HVAC system 100 in the dehumidification mode. For example, one or more control transfer devices, such as wires, cables, wireless communication devices, and the like, may communicatively couple the blower 130, the expansion device 154, the compressor 160, the condenser fans 168, the modulating valve 190, the first and second valves 192, 194, and/or any other suitable components of the HVAC system 100 and/or the reheat control system 102 to the controller 200. That is, the blower 130, the expansion device 154, the compressor 160, the condenser fans 168, the modulating valve 190, and/or the first and second valves 192, 194 may each have a communication component that facilitates wired or wireless communication between the controller 200, the blower 130, the expansion device 154, the compressor 160, the condenser fans 168, the modulating valve 190, and/or the first and second valves 192, 194 via a network. In some embodiments, the communication component may include a network interface that enables the components of the HVAC system 100 to communicate via various protocols such as EtherNet/IP, ControlNet, DeviceNet, or any other communication network protocol. Alternatively, the communication component may enable the components of the HVAC system 100 and components of the reheat control system 102 to communicate via mobile telecommunications technology, Bluetooth®, near-field communications technology, and the like. As such, the controller 200, the blower 130, the expansion device 154, the compressor 160, the condenser fans 168, the modulating valve 190, and/or the first and second valves 192, 194 may wirelessly communicate data between each other.

The controller 200 includes a processor 202, such as a microprocessor, which may execute software for controlling the components of the HVAC system 100 and/or the components of the reheat control system 102. The processor 202 may include multiple microprocessors, one or more "general-purpose" microprocessors, one or more special-purpose microprocessors, and/or one or more application specific integrated circuits (ASICS), or some combination thereof. For example, the processor 202 may include one or more reduced instruction set (RISC) processors. The controller 200 may also include a memory device 204 that may store information such as instructions, control software, look up tables, configuration data, etc. The memory device 204 may include a volatile memory, such as random access memory (RAM), and/or a nonvolatile memory, such as read-only memory (ROM). The memory device 204 may store a variety of information and may be used for various purposes. For example, the memory device 204 may store processor-executable instructions including firmware or software for the processor 202 execute, such as instructions for controlling components of the HVAC system 100 and/or for controlling components of the reheat control system 102. In some embodiments, the memory device 204 is a tangible, non-transitory, machine-readable-medium that may store machine-readable instructions for the processor 202 to execute. The memory device 204 may include ROM, flash memory, a hard drive, or any other suitable optical, magnetic, or solid-state storage medium, or a combination thereof. The memory device 204 may store data, instructions, and any other suitable data.

In some embodiments, the reheat control system 102 may include a first temperature sensor 210 and a second temperature sensor 212 that are positioned within and/or along the air flow path 114 and are communicatively coupled to the controller 200. Indeed, in some embodiments, the first and second temperature sensors 210, 212 are positioned within the enclosure 112 of the HVAC system 100. The first and second temperature sensors 210, 212 may include any suitable temperature measuring instruments such as, for example, dry bulb temperature sensors, resistance temperature detectors (RTDs), thermocouples, thermistors, or other suitable temperature sensors. In certain embodiments, the first temperature sensor 210 may be positioned adjacent to an upstream side 214 of the evaporator assembly 152, with respect to a direction of air flow across the evaporator assembly 152. That is, in some embodiments, the first temperature sensor 210 may be positioned adjacent to an air flow inlet 216 of the evaporator assembly 152. Accordingly, the first temperature sensor 210 may provide the controller 200 with feedback indicative of a temperature, such as a dry bulb temperature, of the return air 128 entering the enclosure 112. The second temperature sensor 212 may be positioned adjacent to a downstream side 218 of the reheat coil 180, with respect to a direction of air flow across the reheat coil 180. That is, in some embodiments, the second temperature sensor 212 may be positioned adjacent to an air flow outlet 219 of the reheat coil 180. Accordingly, the second temperature sensor 212 may provide the controller 200 with feedback indicative of a temperature, such as a dry bulb temperature, of the supply air 156 discharging from the reheat coil 180.

In some embodiments, the controller 200 may, via instructions sent to the modulating valve 190, adjust an amount of refrigerant entering the reheat coil 180 based on feedback from the first temperature sensor 210, the second temperature sensor 212, and based on a control algorithm. In particular, the controller 200 may be configured to operate the reheat coil 180 to reheat the dehumidified air 206 to a temperature that is within a threshold range of a temperature of the return air 128. Accordingly, the controller 200 may enable the HVAC system 100 to provide the thermal load 110 with the neutral air 176, which has a temperature that is substantially similar to a temperature of the return air 128, and has a humidity level that is less than a humidity level of the return air 128.

Figure 6:
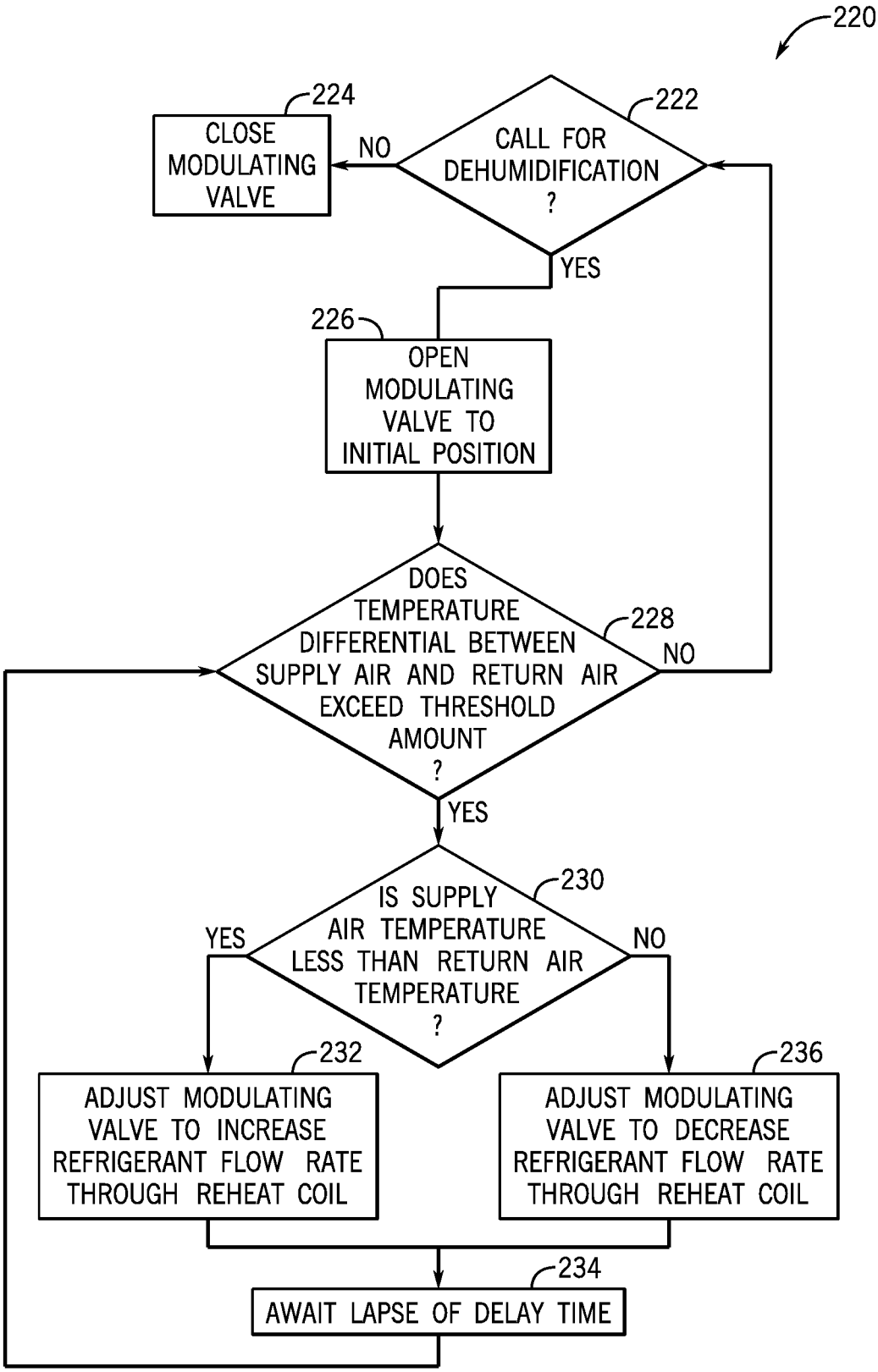
FIG. 6 is a flow diagram of an embodiment of a process of operating an HVAC system having a reheat coil, in accordance with an aspect of the present disclosure.

FIG. 6 is flow diagram of an embodiment of a process 220 that may be used to control the HVAC system 100 and the reheat control system 102 to facilitate supply of the neutral air 176 to the thermal load 110. FIG. 6 will be referred to concurrently with FIG. 5 throughout the following discussion. It should be noted that the steps of the process 220 discussed below may be performed in any suitable order and are not limited to the order shown in the illustrated embodiment of FIG. 6. Moreover, it should be noted that additional steps of the process 220 may be performed, and certain steps of the process 220 may be omitted. In some embodiments, the process 220 may be executed on the processor 202, the microprocessor 86, and/or any other suitable processor of the reheat control system 102 and/or the HVAC system 100. The process 220 may be stored on, for example, the memory 88 or the memory device 204.

The process 220 may begin with the controller 200 determining whether a call to operate the HVAC system 100 in the dehumidification mode exists, as indicated by step 222. For example, in some embodiments, the controller 200 may begin to operate the HVAC system 100 in the dehumidification mode if a humidity level within one or more rooms or zones of the thermal load 110 exceeds a threshold humidity level. If the controller 200 determines that no call to operate the HVAC system 100 in the dehumidification mode exists, the controller 200 may transition the modulating valve 190 to a closed position, as indicated by step 224, and may continue to monitor whether a call for dehumidification is received. If the controller 200 determines that a call to operate the HVAC system 100 in the dehumidification mode exists, the controller 200 may proceed to operate the HVAC system 100 in the dehumidification mode as discussed herein.

As discussed below, in the dehumidification mode, the HVAC system 100 may be configured to circulate air throughout the thermal load 110 without exhausting air from the interior 174 of the thermal load 110 into the ambient environment and without drawing outdoor air from the ambient environment into the interior 174. Indeed, in some embodiments, when initiating operation of the HVAC system 100 in the dehumidification mode, the controller 200 may instruct the exhaust air damper 136 and the outdoor air damper 144 to transition to respective closed positions. Accordingly, the controller 200 enables the HVAC system 100 to circulate air through the enclosure 112 and the thermal load 110 while substantially eliminating air exchange between the thermal load 110 and the surrounding ambient environment.

When initiating operation of the HVAC system 100 in the dehumidification mode at the step 222, the controller 200 may position the modulating valve 190 at an initial position in which the modulating valve 190 is configured to direct a portion of the heated refrigerant discharging from the compressor 160 toward the reheat coil 180, as indicated by step 226. For example, in some embodiments, the initial position of the modulating valve 190 may correspond to a position of the modulating valve 190 that enables approximately half of the refrigerant discharging from the compressor 160 to flow toward the reheat coil 180, while a remaining half of the refrigerant discharging from the compressor 160 flows toward the condenser assembly 166. In other embodiments, the initial position of the modulating valve 190 may direct any suitable portion of the refrigerant discharging from the compressor 160 to the reheat coil 180 and/or to the condenser assembly 166. As an example, in some embodiments, the initial position of the modulating valve 190 may correspond to a position of the modulating valve 190 that enables substantially none of the refrigerant or substantially all of the refrigerant discharging from the compressor 160 to flow toward the reheat coil 180.

Upon initiating operation of the HVAC system 100 in the dehumidification mode, the controller 200 may determine, at step 228, whether a temperature differential between the supply air 156 discharging from the HVAC system 100 and the return air 128 entering the HVAC system 100 is less than or equal to a threshold amount. For example, the controller 200 may receive feedback from the first temperature sensor 210 that is indicative of a temperature of the return air 128 adjacent to the upstream side 214 of the evaporator assembly 152. Additionally, the controller 200 may receive feedback from the second temperature sensor 212 that is indicative of a temperature the supply air 156 adjacent to the downstream side 218 of the reheat coil 180. The controller 200 may evaluate the feedback from the first and second temperature sensors 210, 212 to determine whether a difference between the temperature measurement of the first temperature sensor 210 and the temperature measurement of the second temperature sensor 212 is within the threshold amount. In some embodiments, the threshold amount may be, for example, 0.5 degrees Fahrenheit, 1.0 degree Fahrenheit, or 2.0 degrees Fahrenheit. In other embodiments, the threshold amount may include a predetermined percentage of the temperature of the return air 128. That is, the threshold amount may be a predetermined percentage of a temperature measurement acquired by the first temperature sensor 210.

If the controller 200 determines that a differential between the temperature of the return air 128 and the temperature of the supply air 156 is equal to or less than the threshold amount, the controller 200 may return to the step 222 and proceed to operate the HVAC system 100 in the dehumidification mode. That is, the controller 200 may maintain a current position, such as the initial position, of the modulating valve 190, and may continue to operate the HVAC system 100 to recirculate air throughout the thermal load 110. By determining that the differential between the temperature of the return air 128 and the temperature of the supply air 156 is equal to or less than the threshold amount, the controller 200 may ensure that the supply air 156 includes air parameters that are substantially similar to air parameters of the neutral air 176. Accordingly, the controller 200 may operate the HVAC system 100 to dehumidify the interior 174 of the thermal load 110 without heating or cooling the interior 174. It should be understood that, if the controller 200 receives a call to heat or cool one or more of the rooms or zones of the building 10, the controller 200 may initiate operation of the HVAC system 100 a heating mode or a cooling mode, respectively.

If the controller 200 determines that a differential between the temperature of the return air 128 and the temperature of the supply air 156 is greater than the threshold amount, the controller 200 proceeds to step 230 and determines whether the temperature of the supply air 156 is above or below the temperature of the return air 128. If the controller 200 determines the that supply air 156 temperature is less than the return air 128 temperature by the threshold amount, the controller 200 may adjust the initial position of the modulating valve 190 to increase a flow rate of refrigerant circulating through the reheat coil 180, as indicated by step 232. For example, the controller 200 may adjust the modulating valve 190 by a particular adjustment increment to increase a flow rate of refrigerant traveling from the compressor 160 to the reheat coil 180 and to decrease a flow rate of refrigerant traveling from the compressor 160 to the condenser assembly 166. As noted above, the adjustment increment may be one of a plurality of adjustment increments that enable the modulating valve 190 to incrementally increase or decrease refrigerant flow to the reheat coil 180 and/or to the condenser assembly 166. By increasing a refrigerant flow rate to the reheat coil 180, the controller 200 may increase a heat transfer rate between the dehumidified air 206 and the reheat coil coils 182. Accordingly, the controller 200 may increase a temperature of the supply air 156 discharging from the reheat coil 180, such that a temperature of the supply air 156 may approach a temperature of the return air 128.

In some embodiments, upon adjusting the modulating valve 190 by the adjustment increment at the step 232, the controller 200 may await for a delay time to lapse, as indicated by step 234. In some embodiments, the delay time may be, for example, 1 second, 5 seconds, 30 seconds, or more than 30 seconds. Upon lapse of the delay time, the controller 200 may return to the step 228. It should be appreciated that, in other embodiments, the delay time may by substantially negligible, such that the controller 200 may proceed to the step 228 immediately after the modulating valve 190 has transitioned by the adjustment increment at the step 232.

In certain embodiments, the controller 200 may continuously iterate though the steps 228, 230, 232, and 234 until a temperature differential between the supply air 156 discharging from the HVAC system 100 and the return air 128 entering the HVAC system 100 is within the threshold amount. For clarity, as used herein, a new iteration of the process 220 may begin each time the controller 200 performs the step 228. In the present example, by repeatedly iterating through the steps 228, 230, 232, and 234 of the process 220, the controller 200 may incrementally adjust a position of the modulating valve 190 to increase a flow rate of heated refrigerant supplied to the reheat coil 180 during each iteration of the process 220 until the temperature differential between the supply air 156 and the return air 128 is less than or equal to the threshold amount. Accordingly, the controller 200 may adjust a heat output of the reheat coil 180 in real time to enable a temperature of the supply air 156 to approach a temperature of the return air 128. If, during a particular iteration of the process 220, the controller 200 determines, at the step 228, that a temperature differential between the supply air 156 and the return air 128 is less than or equal to the threshold amount, the controller 200 may maintain the current position of the modulating valve 190 and may return to the step 222.

If, during a particular iteration of the process 220, the controller 200 determines the that the supply air 156 temperature exceeds the return air 128 temperature by the threshold amount at the step 230, the controller 200 may adjust the position of the modulating valve 190 by an adjustment increment to decrease a flow rate of heated refrigerant supplied to the reheat coil 180, as indicated by step 236. For example, the controller 200 may adjust the modulating valve 190 by the adjustment increment to decrease a flow rate of heated refrigerant traveling from the compressor 160 to the reheat coil 180 and to increase a flow rate of heated refrigerant traveling from the compressor 160 to the condenser assembly 166. By decreasing a refrigerant flow rate to the reheat coil 180, the controller 200 may decrease a heat transfer rate between the dehumidified air 206 and the reheat coil coils 182. Accordingly, the controller 200 may decrease a temperature of the supply air 156 discharging from the reheat coil 180, such that a temperature of the supply air 156 may approach the temperature of the return air 128.

Upon adjusting the modulating valve 190 at the step 236, the controller 200 may await lapse of the delay time at the step 234, and may subsequently return to the step 228. The controller 200 may repeatedly iterate though the steps 228, 230, 234, and 236 to incrementally decrease a flow rate of refrigerant supplied to the reheat coil 180 until a temperature differential between the supply air 156 and the return air 128 is less than or equal to the threshold amount. Accordingly, by iterating through the steps of the process 220, the controller 200 may ensure that a temperature measurement of the second temperature sensor 212 approaches and remains at a value that is substantially equal to a temperature measurement of the first temperature sensor 210. As such, the controller 200 enables the HVAC system 100 to supply the neutral air 176 to the thermal load 110, which includes a humidity level that is less than a humidity level of the return air 128 and includes a temperature value that is substantially equal to, or within a threshold amount of, a temperature value of the return air 128.

It should be appreciated that positioning the first temperature sensor 210 and the second temperature sensor 212 within the enclosure 112 of the HVAC system 100 may enhance an operational efficiency and/or a reaction rate of the reheat control system 102. For example, positioning the first temperature sensor 210 adjacent to the air flow inlet 216 of the evaporator assembly 152 and positioning the second temperature sensor 212 adjacent to the air flow outlet 219 of the reheat coil 180 may ensure that a distance along the air flow path 114 between the first temperature sensor 210 and the second temperature sensor 212 is relatively small. In this manner, the controller 200 may determine a temperature of the supply air 156 prior to the supply air 156 interacting with other structures or components of the HVAC system 100, such as the supply duct 122, which may absorb thermal energy from or transfer thermal energy to the supply air 156. Accordingly, the controller 200 may be able to more accurately and quickly detect temperature variations between the return air 128 and the supply air 156. That is, the controller 200 may determine a temperature of the supply air 156 as soon as the supply air 156 discharges from the air flow outlet 219 of the reheat coil 180 instead of, for example, determining a temperature of the supply air 156 once the supply air 156 enters the thermal load 110, such as via a thermostat positioned within the thermal load 110. Therefore, the controller 200 may adjust a position of the modulating valve 190 based on temperature measurements acquired within the enclosure 112, instead of temperature measurements acquired within the thermal load 110.

Advantageously, such a configuration enables the controller 200 to adjust and/or update the position of the modulating valve 190 in a manner that mitigates temperature fluctuations within the thermal load 110. For example, if the controller 200 were instead configured to adjust the position of the modulating valve 190 based on a measured temperature of the interior 174, the controller 200 would adjust the modulating valve 190 upon a determination that the HVAC system 100 has already over-cooled or over-heated the interior 174. As one of ordinary skill in the art would understand, in such embodiments, a substantial time period may lapse before the controller 200 is able to determine that adjustment of the modulating valve 190 is desired when the determination is based on a measured temperature of the interior 174. As a result, the response time of the reheat control system 102 to adjust HVAC system 100 operation in order to generate the supply air 156 at a desired temperature may be greatly increased. Indeed, the controller 200 may determine that such adjustment is desired, in particular, after the HVAC system 100 has over-cooled or over-heated a substantial or entire portion of the interior 174, which may include a relatively large volume of space. Thereafter, once the desired adjustment is determined, conditioning the over-cooled or over-heated interior 174 to achieve the desired temperature may involve extended operation of the HVAC system 100, which increases energy usage and costs.

Moreover, as one of ordinary skill would appreciate, repeatedly over-cooling or over-heating the interior 174 may consume significant power or electrical energy, and thus, reduce an overall operational efficiency of the HVAC system 100. Accordingly, embodiments of the controller 200 disclosed herein, which are configured to adjust the modulating valve 190 based on a temperature measurement of the supply air 156 within the enclosure 112, rather than an air temperature measurement within the interior 174 of the thermal load 110, enable more efficient adjustment of a heat output rate of the reheat coil 180 to mitigate over-cooling or over-heating of the interior 174.

It should be understood that, in other embodiments, the first temperature sensor 210, the second temperature sensor 212, or both the first and second temperature sensors 210, 212 may be positioned within the thermal load 110. Moreover, in certain embodiments, the first temperature sensor 210 may be positioned within the exhaust duct 124 and/or the second temperature sensor 212 may be positioned within the supply duct 122. In some embodiments, the first temperature sensor 210 may be positioned adjacent to an interface between the exhaust duct 124 and the enclosure 112, and the second temperature sensor 212 may be positioned adjacent to an interface between the supply duct 122 and the enclosure 112.

In any case, it should be appreciated that, in embodiments where the first and second temperature sensors 210, 212 are positioned within the enclosure 112, the reheat control system 102 is integrated with the HVAC system 100, such that the HVAC system 100, when coupled to a suitable building or other structure, is configured to provide the neutral air 176 in the dehumidification mode without involving installation of dedicated temperature sensors within the building 10 or structure serviced by the HVAC system 100. In other words, the full integration of the reheat control system 102 with the HVAC system 100 and enclosure 112 enables efficient installation and configuration of the HVAC system 100 having the functionality disclosed herein. For example, integration of the reheat control system 102 within the enclosure 112 may reduce time and/or cost associated with installation and/or retrofitting the HVAC system 100 with a particular building or structure.

In some embodiments, if the temperature differential between the supply air 156 discharging from the HVAC system 100 and the return air 128 entering the HVAC system 100 is less than or equal to the threshold amount at the step 228, the controller 200 may adjust components of the reheat control system 102 to achieve a desired dehumidification setpoint for the supply air 156. For example, in some embodiments, the controller 200 may be communicatively coupled a humidity sensor 242 that is configured to measure a humidity level of the supply air 156. In some embodiments, the humidity sensor 242 may be positioned adjacent to the air flow outlet 219 of the reheat coil 180, within the supply duct 122, or within thermal load 110.

As a non-limiting example, if the temperature differential between the supply air 156 discharging from the HVAC system 100 and the return air 128 entering the HVAC system 100 is less than or equal to the threshold amount, and the humidity level of the supply air 156 is less than a target humidity level of the supply air 156 by a threshold amount, the controller 200 may adjust the first and second valves 192, 194 to enable refrigerant discharging from the reheat coil 180 to flow directly toward the expansion device 154. That is, the controller 200 may instruct the first valve 192 to transition to a closed position and may instruct the second valve 194 to transition to an open position, such that refrigerant discharging from the reheat coil 180 at a first temperature value is directed toward the expansion device 154. Accordingly, the HVAC system 100 may continue to supply the thermal load 110 with the supply air 156 at the target humidity level and at a temperature that is substantially equal to a temperature of the return air 128 entering the HVAC system 100.

If the temperature differential between the supply air 156 discharging from the HVAC system 100 and the return air 128 entering the HVAC system 100 is less than or equal to the threshold amount, and the humidity level of the supply air 156 exceeds the target humidity level by a threshold amount, the controller 200 may, in some embodiments, transition the first valve 192 to an open position and transition the second valve 194 to a closed position. Accordingly, the controller 200 may enable refrigerant discharging from the reheat coil 180 to flow toward the condenser assembly 166. In accordance with the techniques discussed above, the condenser assembly 166 may enable ambient air to absorb thermal energy from the refrigerant circulating therethrough, such that the refrigerant is further cooled and directed toward the expansion device 154 at a second temperature that may be less than the first temperature of the refrigerant discharging from the reheat coil 180. That is, by directing the refrigerant through the reheat coil 180 and the condenser assembly 166, the controller 200 may enable the refrigerant to flow toward the expansion device 154 at a temperature that is less than a temperature of the refrigerant that may be supplied to the expansion device 154 when the refrigerant is blocked from flowing through the condenser assembly 166 and is instead directed from the reheat coil 180 to the expansion device 154. As such, the refrigerant discharging from the condenser assembly 166 may further decrease a temperature of the evaporator coils 153 and, thus, enable the evaporator assembly 152 to condense an increased amount of moisture from the return air 128, as compared to an amount of moisture that may be condensed from the return air 128 when the refrigerant is not circulated through the condenser assembly 166. In this manner, the controller 200 may adjust refrigerant flow through the vapor compression system 150 to enable a humidity level of the supply air 156 to approach the target humidity level of the supply air 156.

It should be understood that the controller 200 may, at the step 228, adjust the first and second valves 192, 194 to block refrigerant flow through the condenser assembly 166 if the evaporator assembly 152 decreases a temperature of the supply air 156 below the temperature of the return air 128 by the threshold amount. That is, the controller 200 may adjust the first and second valves 192, 194 to block refrigerant flow through the condenser assembly 166 if the evaporator assembly 152 sufficiently decreases a temperature of the supply air 156 to enable the temperature differential between the supply air 156 and the return air 128 to exceed the threshold amount. Upon transitioning the first and second valves 192, 194 to block refrigerant flow from the reheat coil 180 to the condenser assembly 166, the controller 200 may again iterate through the steps 228, 230, 232, 234, and/or 236 of the process 220 until the temperature differential between the supply air 156 and the return air 128 is less than or equal to the threshold amount. Accordingly, it should be appreciated that the controller 200 may adjust the reheat control system 102 to attempt to reach the target dehumidification setpoint of the supply air 156 as a secondary consideration after the temperature differential between the supply air 156 and the return air 128 has been adjusted to be less than or equal to the threshold amount.

Moreover, as noted above, it should be appreciated that the first valve 192 and the second valve 194 may be replaced with a three-way valve that is configured to regulate diversion of refrigerant from the reheat coil 180 to the condenser assembly 166 and to the expansion device 154. That is, the three-way valve may be fluidly coupled to the conduit 186, the conduit 165, and the conduit 170, and may be configured to direct refrigerant from the reheat coil 180 toward the condenser assembly 166 or directly toward the expansion device 154. In certain embodiments, the controller 200 may be configured to adjust the three-way valve to direct a first portion of the refrigerant discharging from the reheat coil 180 toward the condenser assembly 166 via the conduit 165 and to direct a remaining portion of the refrigerant discharging from the reheat coil 180 to the expansion device 154. Accordingly, the controller 200 may modulate a position of the three-way valve to adjust a temperature value of the refrigerant entering the evaporator assembly 152 and, thus, adjust an amount of dehumidification provided by the evaporator assembly 152. In this manner, the controller 200 may more precisely control an amount of dehumidification provided by the evaporator assembly 152 to facilitate achieving the desired target humidity level of the supply air 156 without causing the temperature differential between the supply air 156 and the return air 128 to exceed the threshold amount.

As set forth above, embodiments of the present disclosure may provide one or more technical effects useful for regulating a heat transfer rate between the reheat coil 180 and the dehumidified air 206. In particular, the controller 200 may adjust an amount of refrigerant supplied to the reheat coil 180 based on a temperature differential between the return air 128 upstream of the evaporator assembly 152 and the supply air 156 discharged from the reheat coil 180. In this manner, the controller 200 enables the HVAC system to discharge the supply air 156 as the neutral air 176, which includes a temperature value that is substantially equal to a temperature value of the return air 128 and a humidity level that is less than a humidity level of the return air 128. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system comprising a controller configured to:

receive, from a first sensor, first feedback indicative of a first temperature of an air flow received by the HVAC system as return air;

receive, from a second sensor, second feedback indicative of a second temperature of the air flow output by the HVAC system as supply air; and control a modulating reheat valve of the HVAC system to adjust flow of a working fluid to a reheat coil in thermal communication with the air flow, wherein, to control the modulating reheat valve, the controller is configured to:

instruct the modulating reheat valve to increase a flow rate of the working fluid to the reheat coil in response to a first determination that the second temperature is below the first temperature by a non-zero threshold amount; or instruct the modulating reheat valve to decrease the flow rate of the working fluid to the reheat coil in response to a second determination that the second temperature is above the first temperature by the non-zero threshold amount; or both.

2. The HVAC system of claim 1, wherein the controller is configured to control the modulating reheat valve to decrease a difference between the first temperature and the second temperature.

3. The HVAC system of claim 1, comprising the first sensor, wherein the HVAC system comprises ductwork configured to direct the air flow received by the HVAC system as the return air into an enclosure of the HVAC system, wherein the first sensor is disposed within the ductwork or within the enclosure of the HVAC system.

4. The HVAC system of claim 3, comprising an evaporator disposed within the enclosure and configured to receive the return air, wherein the first sensor is disposed adjacent to an inlet of the evaporator.

5. The HVAC system of claim 4, comprising the reheat coil and the second sensor, wherein the reheat coil is disposed downstream of the evaporator relative to flow of the return air through the enclosure, and wherein the second sensor is disposed adjacent to an outlet of the reheat coil.

6. The HVAC system of claim 1, comprising the modulating reheat valve, wherein the modulating reheat valve is configured to distribute flow of the working fluid between the reheat coil and a condenser of the HVAC system.

7. The HVAC system of claim 6, wherein the modulating reheat valve is configured to transition between a plurality of discrete positions to adjust distribution of the flow of the working fluid between the reheat coil and the condenser.

8. The HVAC system of claim 7, wherein the plurality of discrete positions corresponds to five or more discrete positions of the modulating reheat valve.

9. The HVAC system of claim 1, comprising an evaporator configured to receive the return air and comprising the reheat coil, wherein, in response to a third determination that a difference between the first temperature and the second temperature is less than or equal to the non-zero threshold amount, the controller is configured to determine whether a humidity level of the supply air is above or below a target humidity level by an additional threshold amount.

10. The HVAC system of claim 9, wherein, in response to a fourth determination that the humidity level of the supply air is above the target humidity level by the additional threshold amount, the controller is configured to adjust a valve assembly of the HVAC system to increase flow of the working fluid from the reheat coil to a condenser of the HVAC system.

11. The HVAC system of claim 10, wherein, in response to a fifth determination that the humidity level of the supply air is below the target humidity level by the additional threshold amount, the controller is configured to adjust the valve assembly to decrease flow of the working fluid from the reheat coil to the condenser.

12. A heating, ventilation, and/or air conditioning (HVAC) unit, comprising:

an enclosure defining an air flow path;

an evaporator and a reheat coil disposed within the air flow path, wherein the evaporator and the reheat coil are each configured to receive a working fluid of a vapor compression system;

a first sensor positioned upstream of the evaporator along the air flow path;

a second sensor positioned downstream of the reheat coil along the air flow path;

a modulating reheat valve configured to transition between a plurality of discrete positions, wherein the modulating reheat valve is configured to distribute the working fluid to the reheat coil and to a condenser of the HVAC unit in parallel in each discrete position of the plurality of discrete positions; and a controller configured to adjust the modulating reheat valve between the plurality of discrete positions to control a difference between a first measurement provided by the first sensor and a second measurement provided by the second sensor.

13. The HVAC unit of claim 12, wherein the controller is configured to instruct the modulating reheat valve to increase a flow rate of the working fluid to the reheat coil in response to a determination that the second measurement provided by the second sensor is below the first measurement provided by the first sensor by a non-zero threshold amount.

14. The HVAC unit of claim 12, wherein the controller is configured to instruct the modulating reheat valve to decrease a flow rate of the working fluid to the reheat coil in response to a determination that the second measurement provided by the second sensor is above the first measurement provided by the first sensor by a non-zero threshold amount.

15. The HVAC unit of claim 12, wherein the first sensor and the second sensor are positioned within an interior of the enclosure.

16. The HVAC unit of claim 12, wherein the first sensor and the second sensor are dry bulb temperature sensors.

17. A control system of a heating, ventilation, and/or air conditioning (HVAC) system, wherein the control system comprises a controller configured to:

receive, from a first sensor, first feedback indicative of a first temperature of return air received by the HVAC system;

receive, from a second sensor, second feedback indicative of a second temperature of supply air discharged by the HVAC system; and instruct a modulating reheat valve to increase a flow rate of a working fluid to a reheat coil in fluid communication with the return air in response to a determination that the second temperature is below the first temperature by a non-zero threshold amount.

18. The control system of claim 17, wherein the controller is configured to instruct the modulating reheat valve to decrease the flow rate of the working fluid to the reheat coil in response to a second determination that the second temperature is above the first temperature by the non-zero threshold amount.

19. The control system of claim 17, wherein the controller is configured to control the modulating reheat valve to decrease a difference between the first temperature and the second temperature, such that the difference is below the non-zero threshold amount.

* * * * *